US009182110B2

(12) United States Patent
Kadijk et al.

(10) Patent No.: US 9,182,110 B2
(45) Date of Patent: Nov. 10, 2015

(54) LIGHTING DEVICE WITH A CIRCUIT BOARD MOUNTING

(75) Inventors: Simon Eme Kadijk, Veldhoven (NL); Peter Johannes Martinus Bukkems, Deume (NL); Jeroen Johannes Maria Zaal, Nijmegen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/344,073

(22) PCT Filed: Sep. 11, 2012

(86) PCT No.: PCT/IB2012/054710

§ 371 (c)(1),
(2), (4) Date: Mar. 11, 2014

(87) PCT Pub. No.: WO2013/042008

PCT Pub. Date: Mar. 28, 2013

(65) Prior Publication Data

US 2014/0376238 A1 Dec. 25, 2014

Related U.S. Application Data

(60) Provisional application No. 61/538,180, filed on Sep. 23, 2011.

(51) Int. Cl.

| | |
|---|---|
| ***F21V 23/00*** | (2015.01) |
| ***F21K 99/00*** | (2010.01) |
| ***F21V 21/00*** | (2006.01) |
| *F21Y 101/02* | (2006.01) |

(52) U.S. Cl.

CPC ..... *F21V 23/006* (2013.01); *F21K 9/13* (2013.01); *F21V 21/00* (2013.01); *F21K 9/137* (2013.01); *F21K 9/90* (2013.01); *F21Y 2101/02* (2013.01)

(58) Field of Classification Search

CPC ... F21V 19/001; F21V 23/005; F21V 23/006; F21S 4/003

USPC ..... 362/249.02, 646, 249.11, 382, 373

See application file for complete search history.

(56) References Cited

U.S. PATENT DOCUMENTS

| | | | | |
|---|---|---|---|---|
| 8,408,743 | B1 * | 4/2013 | Chen et al. | 362/249.02 |
| 8,888,318 | B2 * | 11/2014 | Yang et al. | 362/235 |
| 2006/0215422 | A1 | 9/2006 | Laizure, Jr. et al. | |
| 2007/0025109 | A1 | 2/2007 | Yu | |
| 2008/0023199 | A1 | 1/2008 | Szymaski et al. | |
| 2008/0232119 | A1 | 9/2008 | Ribarich | |

(Continued)

FOREIGN PATENT DOCUMENTS

| | | | |
|---|---|---|---|
| CN | 101886767 | A | 11/2010 |
| CN | 201696921 | U | 1/2011 |

(Continued)

*Primary Examiner* — Anabel Ton
(74) *Attorney, Agent, or Firm* — Yuliya Mathis

(57) ABSTRACT

The present invention relates to a lighting device (1). The lighting device comprises a light source (3), a circuit board (7) configured to control the light source, and a circuit board frame (10) comprising a slot (12). Further, an edge (8) of the circuit board is mounted in the slot such that the circuit board is in thermal contact with the circuit board frame, thereby enabling heat to be conducted from the circuit board to the circuit board frame. The present invention is advantageous in that the thermal performance of the lighting device is improved and manufacturing costs are reduced.

14 Claims, 4 Drawing Sheets

(56) References Cited

U.S. PATENT DOCUMENTS

| | | | | |
|---|---|---|---|---|
| 2008/0232199 | A1 | 9/2008 | Shafton | |
| 2008/0285269 | A1 | 11/2008 | Chan | |
| 2009/0051265 | A1 | 2/2009 | Ikada et al. | |
| 2010/0060130 | A1 | 3/2010 | Li | |
| 2011/0101841 | A1 | 5/2011 | Qin | |
| 2011/0101868 | A1 | 5/2011 | Weiss | |
| 2012/0218748 | A1 * | 8/2012 | Conrad | 362/230 |

FOREIGN PATENT DOCUMENTS

| | | | |
|---|---|---|---|
| EP | 1995510 | A1 | 11/2008 |
| EP | 2077415 | A1 | 7/2009 |
| JP | 2008135749 | A | 6/2008 |
| JP | 2009093926 | A | 4/2009 |
| KR | 10107349 | B1 | 2/2011 |
| WO | 2009089529 | A1 | 7/2009 |

* cited by examiner

LIGHTING DEVICE WITH A CIRCUIT BOARD MOUNTING

FIELD OF THE INVENTION

The present invention generally relates to the field of lighting devices having a circuit board for controlling the lighting device. In particular, the present invention relates to arrangements for mounting such a circuit board in the lighting device.

BACKGROUND OF THE INVENTION

Non-incandescent lighting devices generally require driving electronics including a circuit board, such as a printed circuit board, PCB, for driving and controlling the lighting device. For example, lighting devices based on light emitting diodes, LEDs, requires a PCB for driving and controlling the LEDs.

In such non-incandescent lighting devices, the base of the lighting device typically comprises metal. For example, the base may be a metal screw base (cap) adapted to fit and be in electrical contact with a light fitting, and, in particular in LED based lighting devices, the base may comprise a metal heat sink for cooling the LEDs and the driving electronics. The cooling is necessary for maintaining a sufficiently low operating temperature, which extends the life time of the lighting device. Conventionally, to electrically insulate the PCB from any metal parts in the base of the lighting device, potting is used to encapsulate the PCB. The potting is also used to secure the PCB to the base of the lighting device and to conduct heat from the PCB to the heat sink. The potting may e.g. comprise epoxy or silicone. Without the use of potting, the PCB gets thermally insulated and heat dissipation from the PCB is reduced, thereby deteriorating the thermal performance of the lighting device and limiting the maximal output power.

US 2008/0232199 shows an LED lamp having a metal screw base. The screw base is filled with thermally conductive epoxy that secures the PCB and thermally conducts heat away from the LED and the ballast circuit mounted on the PCB to the metal screw base which also forms a heat sink. A drawback with such an arrangement is that thermally conductive epoxy is relatively expensive, and since the base needs to be filled with such epoxy, material costs are high.

SUMMARY OF THE INVENTION

Thus, there is a need for providing alternatives and/or new devices that would overcome, or at least alleviate or mitigate, at least some of the above mentioned drawbacks. An object of the present invention is to provide an improved alternative to the above mentioned technique and prior art. More specifically, it is an object of the present invention to provide a lighting device with an improved thermal performance and a reduced manufacturing cost in comparison with the prior art.

These and other objects of the present invention are achieved by means of a lighting device with the features defined in the independent claim. Preferable embodiments of the invention are characterized by the features set forth in the dependent claims.

Hence, according to the present invention, a lighting device is provided. The lighting device comprises a light source, a circuit board configured to control (or power or drive) the light source, and a circuit board frame comprising a slot. Further, an edge of the circuit board is mounted in the slot such that the circuit board is in thermal contact with the circuit board frame, thereby enabling heat to be conducted from the circuit board to the circuit board frame. Preferably, heat is subsequently dissipated from the circuit board frame onwards to the surroundings e.g. via a heat sink (or heat dissipating component).

The present invention is based on the insight that encapsulating the circuit board with potting (as in prior art techniques) reduces reworkability and makes recycling more complicated as the potting material adheres to the circuit board. Further, in such prior art techniques, the base needs to be filled with potting material, thereby increasing the weight and material cost of the lighting device.

The present invention is based on the idea of instead using a circuit board frame to retain the circuit board in the lighting device. The mounting of the circuit board in the slot of the circuit board frame provides heat dissipation from the circuit board as heat can be conducted from the circuit board, via the circuit board frame, to for instance a heat sink of the lighting device or the ambient air. As the slot clasps (or snugly surrounds) the edge of the circuit board, an increased thermal contact area is provided by the overlap between the circuit board and the circuit board frame (preferably on the two opposite sides of the circuit board), which is advantageous in that an improved cooling of the driving electronics of the lighting device is obtained, thereby extending the life time of the lighting device. Hence, an improved thermal performance of the lighting device is obtained. Optionally, the circuit board may be fastened in the slot by means of gluing or soldering in addition to the clamping that the slot may provide.

Further, the present invention is advantageous in that assembly of the lighting device is facilitated as the circuit board may simply be slid (or inserted) into the slot of the circuit board frame. Consequently, also recycling of the lighting device is facilitated, as the circuit board easily may be separated from the circuit board frame by pulling it out of the slot. The lighting device is preferably designed to allow insertion and removal of the circuit board along the direction of the slot, rather than by urging the circuit board edge into the slot along the normal direction, which may require harmful bending of the circuit board. Further, with the present invention, less material is needed for securing the circuit board to the lighting device, which is advantageous in that the weight of the lighting device as well as material costs are reduced. In addition, a lower weight facilitates logistic handling of the lighting device products.

According to an embodiment of the present invention, the circuit board frame may comprise an electrically insulating material (such as plastics) for electrically insulating the circuit board. The electrically insulating material may for example be provided along the slots and/or as a coating of the circuit board frame. Preferably, most or all the circuit board frame may be made of an electrically insulating material. The present embodiment is advantageous in that the circuit board is electrically isolated from its surroundings, such as from a metal heat sink, a metal screw base or any other component of the lighting device made of an electrically conductive material, thereby reducing the risk of electrically charging parts of the lighting device that are reachable for humans. Alternatively, or as a complement, a separate insulating member may be provided in the lighting device for electrically insulating the circuit board from its surroundings.

In an embodiment of the present invention, the circuit board frame may be at least partly made of thermal plastic, which is advantageous in that the thermal plastic provides electrical insulation and an improved thermal conductivity. In the present disclosure, the term "thermal plastic" refers to a plastic material with a filler which increases the thermal conductivity of the plastic. Hence, the circuit board may be electrically, but not thermally, insulated from its surroundings (including metallic parts, such as the heats sink, in the base of the lighting device), whereby the thermal performance of the lighting device is further improved while reducing the risk of electricity to be conducted to parts of the lighting device reachable for humans.

According to an embodiment of the present invention, the slot may be straight and the circuit board slightly curved, thereby improving the physical contact between the circuit board and the circuit board frame and further securing the circuit board to the circuit board frame. Generally, circuit boards naturally get slightly curved during manufacture due to warpage as a consequence of component soldering. Since the slot is straight, a slight mechanical stress is provided as the circuit board is slid into the slot, which will cause the circuit board to be frictionally retained in the circuit board frame. Advantageously, the slot is sufficiently narrow that the circuit board can only be received therein when the circuit board is urged into a slightly flattened shape. The greater and/or tighter physical contact area in turn improves the thermal contact between the circuit board and the circuit board frame. Alternatively, a straight PCB may be combined with a slightly warped slot to obtain similar results.

According to an embodiment of the invention, the circuit board frame may further comprise a rib in which the slot extends. The slot may be defined by one or more inner surfaces of the rib. In the present disclosure, the term "rib" refers to an elongated, preferably protruding member. The rib may protrude from a supporting member, which e.g. may be the base of the lighting device or a ring-shaped element adapted to support the ribs in the lighting device. The slot may extend in the longitudinal direction of the rib. Further, the rib may be either freestanding or integral with a straight or curved surface which is tangential to the rib. The rib may e.g. extend along the inside of a housing enclosing the circuit board or along the inside of the heat sink. The present embodiment is advantageous in that material consumption and costs can be reduced, in particular if the rib is freestanding and no additional material is used to enclose the circuit board. Further, by virtue of the design freedom regarding thickness and the like, the rib may provide a rigid support for the circuit board, an improved clasping of the circuit board edge and an increased overlap, i.e. an increased thermal contact area, between the circuit board and the circuit board frame.

In an embodiment of the present invention, the circuit board frame may further comprise an electrically insulating housing enclosing (or surrounding) the circuit board, thereby protecting the circuit board and electrically insulating it from its surroundings, such as the heat sink. Further, the housing increases the heat dissipating area of the circuit board frame as heat can be conducted from the slot walls/area to the housing. The electrically insulating housing may for instance be essentially tube shaped and surround the circuit board. The slots may be provided at the inner walls of the housing, e.g. extending in the longitudinal direction of the tube-shaped housing. The housing may be made of thermal plastic, thereby increasing the heat dissipation from the circuit board frame. In an embodiment, the rib may be integral with the housing enclosing the circuit board, thereby increasing the thermal contact area between the circuit board frame and the circuit board.

According to an embodiment of the present invention, the circuit board frame further may comprise an electrically insulating foil, such as a polyimide film, wherein the foil and the rib together enclose (or surround) the circuit board. For example, the foil may, together with the rib, be essentially tube-shaped and the rib may extend along the longitudinal direction of the tube shape. The present embodiment is advantageous in that protection and electrical insulation of the circuit board is enhanced. Further, material costs may be reduced since the foil may be fabricated from a cheaper material than the ribs (and the electrically insulating housing) which may be fabricated from thermal plastic.

Alternatively, no housing or foil to enclose the circuit board may be used if the distance from the electric components of the circuit board to the inner wall of the heat sink (or any other metal part in the base) is long enough to reduce the risk of sparking between the electric components and the heat sink.

In an embodiment of the present invention, the lighting device may further comprise a base, wherein the circuit board frame is integral with an external portion of the base. The present embodiment is advantageous in that the heat dissipating area of the circuit board frame is increased, in particular if the base is made of thermal plastic. Further, as the circuit board frame is integral with the base of the lighting device, the number of components in the lighting device is reduced, thereby facilitating manufacture as well as recycling. It will be appreciated that the base of the lighting device may be the part that is arranged to support the light source and its driving electronics, and support the lighting device in a light fitting.

According to an embodiment of the present invention, the lighting device may further comprise a heat sink (preferably made of metal) arranged in thermal contact with the circuit board frame, which is advantageous in that heat can be conducted away from the circuit board, via the circuit board frame, to the heat sink, thereby further improving the cooling of the circuit board.

In an embodiment of the present invention, the slot may at least 1 mm deep, preferably at least 2 mm deep and even more preferably at least 4 mm deep. A deeper slot provides an increased overlap and thus increases the size and thermal conductivity of the contact area between the circuit board and the circuit board frame. Further, the slot may not be deeper than, but rather essentially correspond to (or be slightly more shallow than), the shortest distance from the electric components of the circuit board to the edge of the circuit board. The overlap may preferably be as large as possible while not obstructing the other components of the lighting device.

In an embodiment of the present invention, self-heating components of the circuit board may be arranged in proximity of the edge of the circuit board, thereby reducing the distance between those components and the circuit board frame, which improves the cooling of the components. Further, by increasing the percentage of the circuit board area covered with electrically conductive material, such as Ag or Cu and extending (or localizing) such coverage towards the edge mounted in the circuit board frame, the cooling of the circuit board is further improved.

According to an embodiment of the present invention, the circuit board frame may comprise an additional slot in which another edge of the circuit board may be mounted such that the circuit board also is in thermal contact with the circuit board frame in the additional slot. To receive a substantially straight circuit board, the slots may be located such that they are facing each other. The present embodiment is advantageous in that the thermal contact area between the circuit board and the circuit board frame is enlarged and the fastening of the circuit board to the circuit board frame is enhanced. Preferably, the two slots of the circuit board frame may be arranged opposite each other, such that two opposing edges of the circuit board may be mounted in (and slid into) the slots of the circuit board frame.

According to an embodiment of the present invention, the ribs may be moulded onto the inside of the heat sink. The ribs may then solidify on the inside of the heat sink during the manufacturing process, which improves thermal contact between the ribs and the heat sink. Hence, the metal heat sink acts as a mould during the plastic injection moulding process. Furthermore, the outside of the lighting device, such as the metal heat sink, may be overmoulded with a (preferably thermo) plastic material for improving the electrical safety of the lighting device. The plastic overmould may e.g. be 1 mm thick and cover at least a part of the metal heat sink. Advantageously, the circuit board frame may be moulded in the same processing step as the overmould.

Further objectives of, features of and advantages with the present invention will become apparent when studying the following detailed disclosure, the drawings and the appended claims. Those skilled in the art realize that different features of the present invention can be combined to create embodiments other than those described in the following or the claims.

BRIEF DESCRIPTION OF THE DRAWINGS

This and other aspects of the present invention will now be described in more detail, with reference to the appended drawings showing embodiments of the invention.

All the figures are schematic, not necessarily to scale, and generally only show parts which are necessary in order to elucidate the invention, wherein other parts may be omitted or merely suggested.

DETAILED DESCRIPTION

A lighting device according to an embodiment of the present invention will now be described with reference to FIGS. 1A and 1B.

Figure 1A:
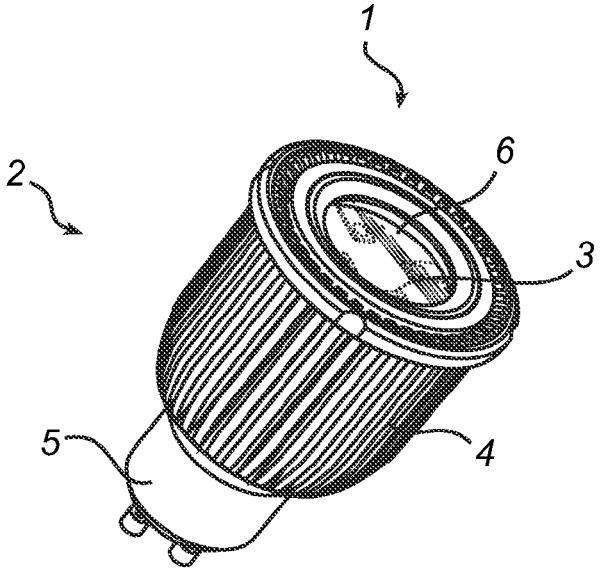
FIG. 1A shows a lighting device according to an embodiment of the present invention.
Figure 1B:
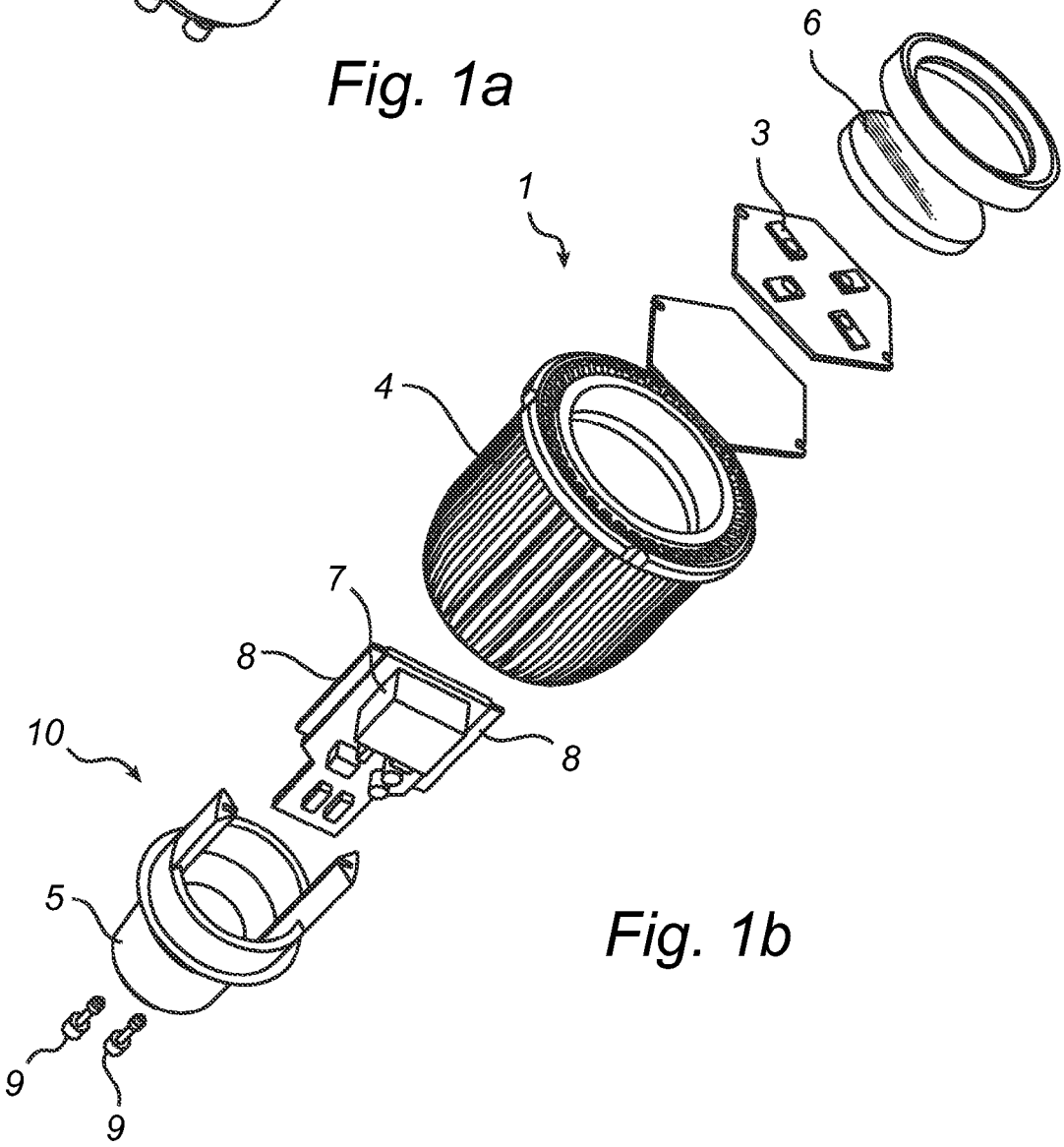
FIG. 1B is an exploded view of the lighting device shown in FIG. 1A.

FIGS. 1A and 1B show a lighting device 1 comprising a base 2 at which light sources 3, such as LEDs, are arranged. The light sources 3 may be covered with a protective screen 6 optionally including lenses or scattering optics. Alternatively, the light sources 3 may be enclosed in a bulb-shaped envelope (not shown). The base 2 comprises a metal heat sink 4, for cooling the light sources 3 and their driving electronics, and a portion 5 adapted for connection to a light fitting. The lighting device 1 further comprises a printed circuit board, PCB 7, for controlling and driving the light sources 3. The PCB 7 is mounted in a circuit board frame 10, or a PCB frame 10, which secures the PCB 7 to the base 2 of the lighting device 1. At least one edge 8 of the PCB 7, but preferably two opposite edges 8 of the PCB 7, are held by the PCB frame 10. Preferably, the PCB frame 10 is in physical contact with the heat sink 4, which is arranged to surround (or enclose) the PCB 7 and the PCB frame 10, thereby facilitating heat conduction therebetween. The lighting device 1 further comprises a connector 9 arranged at said portion 5 of the base 2, to electrically connect the lighting device to a light fitting.

Figure 2A:
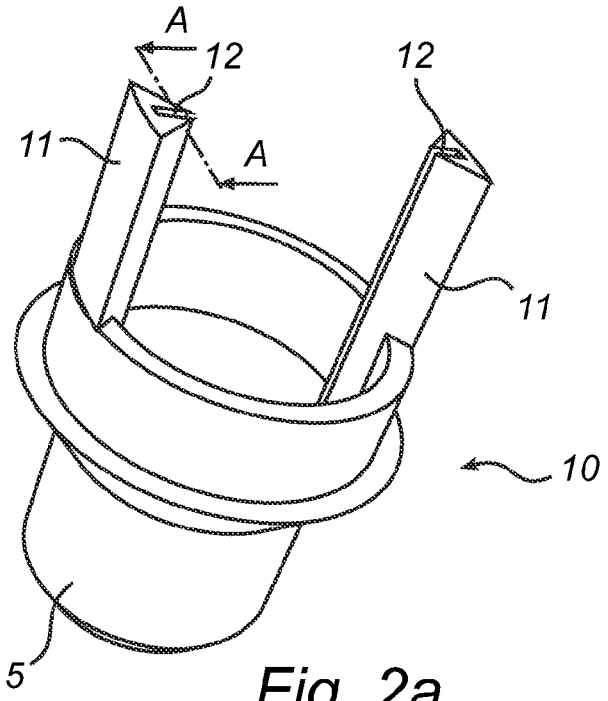
FIG. 2A shows a circuit board frame according to an embodiment of the present invention.
Figure 2B:
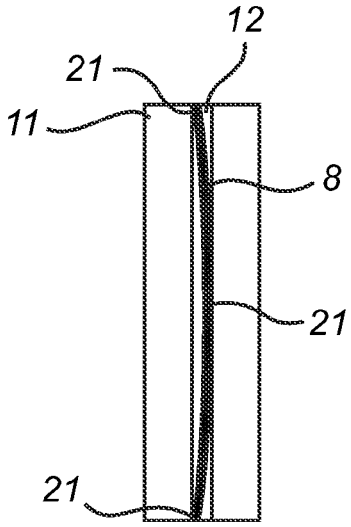
FIG. 2B is a cross-sectional view of a rib of the circuit board frame taken along the line A-A in FIG. 2A, wherein a circuit board is inserted in the rib.

With reference to FIGS. 2A and 2B, the PCB frame 10 according to an embodiment of the present invention will be described in more detail.

FIG. 2A shows the PCB frame 10, in which for the sake of clarity, no PCB 7 is inserted. The PCB frame 10 comprises at least one, but preferably two, ribs 11 provided with slots 12 extending along the longitudinal direction of the ribs 11. The slots 12 are arranged opposite each other, such that two opposing edges of the PCB 7 can be slid into the slots 12. The slots 12 are straight and their width is adapted to be slightly wider than the thickness of the PCB 7. The PCB 7 in turn is slightly curved (or warped) due to the component soldering. FIG. 2B shows a cross sectional view of the rib 11 taken along the line A-A in FIG. 2A, but with the PCB inserted in the slot 12. As the slightly curved PCB 7 is inserted in the straight slots 12, the mechanical stress will press portions 21 of the PCB edges 8 against portions of the inside of the slot 12 in the rib 11, as shown in FIG. 2B. The mechanical stress frictionally secures the PCB 7 to the slot 12 and provides physical contact between the PCB 7 and the rib 11 facilitating heat conduction therebetween. The small air gaps between those portions of the PCB edge 8 that are not in direct physical contact with the rib 11 are small enough to still enable some thermal contact between the PCB 7 and the rib 11.

The PCB frame 10 extends to form a part of, or connects to, the lower portion 5 of the base 2. In other words, the ribs 11 protrude from the portion 5 of the base 2. Preferably, the ribs 11 protrude from the portion 5 of the base 2 in the longitudinal direction of the lighting device, i.e. in a direction essentially parallel with the optical axis of the lighting device. Hence, the PCB 7 may be slid into the slots 12 (towards the portion 5 of the base 2) with a sliding movement in a direction parallel with the longitudinal direction of the slots 12. As the PCB frame 10 forms a part of the portion 5 of the base 2, the heat dissipating area of the PCB frame 10 is enlarged since heat may not just be conducted from the ribs 11 to the heat sink 4, but also to the portion 5 of the base 2, which in turn dissipates the heat to the ambient air.

The PCB frame 10 is partly or (at least almost) entirely made of an electrically insulating material for electrically insulating the PCB 7 from the heat sink 4. For example, the PCB frame 10 may be made of ceramics, but more preferably of plastics, which is a cheaper alternative to ceramics. The plastic may e.g. be a thermoplastic, such as polycarbonate (PC), which is generally used for injection molding. Such common thermoplastic typically has a thermal conductivity of about 0.2/m·K and is advantageous in that it is relatively cheap. Alternatively (or in combination with a common thermoplastic), the PCB frame 10 may be partly or (at least almost) entirely made of thermal plastic. The filler of the thermal plastic may e.g. be ceramic filler or graphite filler in particulate of fibre form. The thermal conductivity of the thermal plastic may range from about 1 up to 15 W/m·K. Thermal plastics with ceramic fillers typically has a thermal conductivity in the range from 1 to 8 W/m·K, and thermal plastics with graphite fillers has a thermal conductivity of up to 15 W/m·K. The thermal plastic is more costly than a common thermoplastic such as PC, but offers a better thermal conductivity, which enhances the thermal path between the PCB 7 and the heat sink 4. However, materials with a thermal conductivity in the range from 0.4 to 1.0 W/m·K may also applicable to the present invention.

The slots 12 may preferably be at least 1 mm deep, and more preferably at least 2 or 4 mm deep.

With a conventional LED lamp, experiments have shown that after filling the heat sink with potting material having a thermal conductivity of 0.5 W/m·K, the average temperature difference is 8° C. between the PCB and the heat sink. In experiments without potting material (and no PCB frame), the average temperature difference is 20° C.

In experiments without potting, but with the application of a PCB frame with ribs made of a thermal plastic having a thermal conductivity of about 2 W/m·K and 2 mm deep slots, an average temperature difference of 14° C. between the PCB and the heat sink is measured. For a PCB frame made of polycarbonate plastic with a thermal conductivity of 0.2 W/m·K, an average temperature difference of 17° C. is found. Hence, the PCB frame according to an embodiment of the invention provides competitive heat dissipation compared to potting techniques.

Figure 3A:
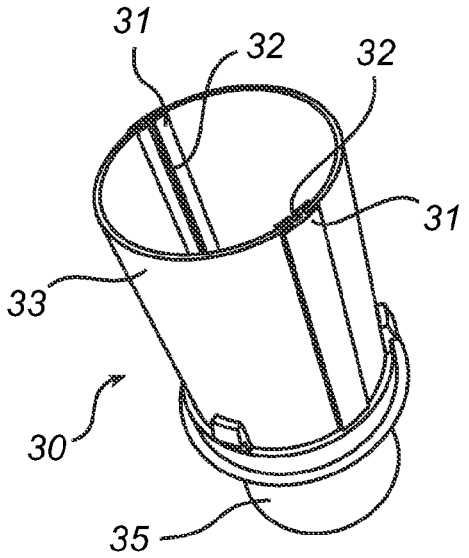
FIG. 3A shows a circuit board frame according to another embodiment of the present invention.
Figure 3B:
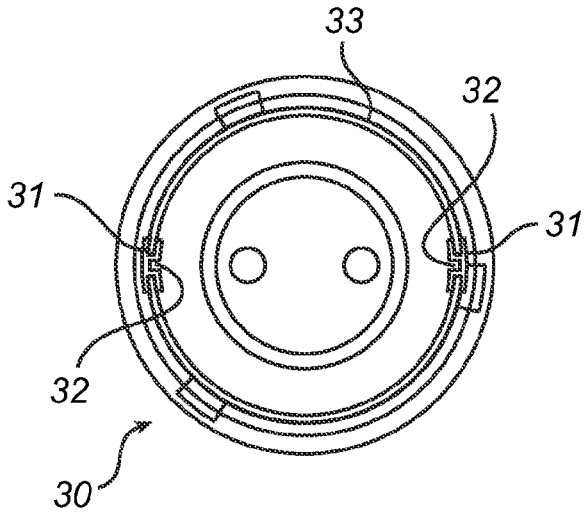
FIG. 3B is a top view of the circuit board frame shown in FIG. 3A.

With reference to FIGS. 3A and 3B, a PCB frame 30 according to another embodiment of the invention will be described. FIG. 3B shows a top view of the PCB frame 30 shown in FIG. 3A.

The PCB frame 30 comprises ribs 31 protruding from the portion 35 which forms a part of the base of the lighting device, and in particular, the portion 35 forms an external portion of the base. Preferably, the ribs 31 and the portion 35 are molded in the same piece, and/or in the same material, to enhance heat conduction from the ribs to the portion 35. Slots 32 extend in the ribs 31, which slots 32 are adapted to receive the edges of the PCB (not shown for the sake of clarity). The PCB frame 30 further comprises an electrically insulating foil 33, wherein the foil 33 and the ribs 31 are adapted to together enclose the PCB. The ribs 31 extend along the longitudinal direction of the essentially tube shaped foil 33, thereby facilitating insertion of the PCB into the PCB frame 30. The slots 32 are arranged opposite each other, such that two opposing edges of the PCB can be slid into the slots 32. The foil may be formed of two rectangular foil portions fastened in the ribs 31. The foil 33 reduces the risk of sparks between the PCB and the heat sink and may for instance be a Kapton® foil.

Figure 4A:
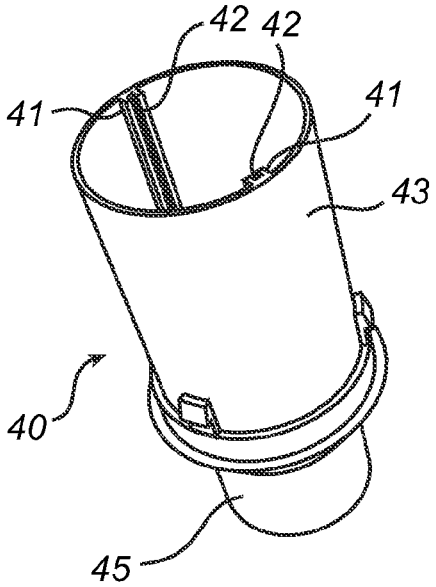
FIG. 4A shows a circuit board frame according to yet another embodiment of the present invention.
Figure 4B:
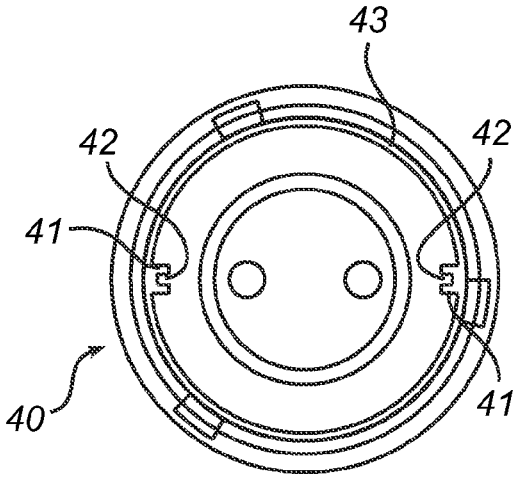
FIG. 4B is a top view of the circuit board frame shown in FIG. 4A.

With reference to FIGS. 4A and 4B, a PCB frame 40 according to yet another embodiment of the invention will be described. FIG. 4B is a top view of the PCB frame 40 shown in FIG. 4A.

The PCB frame 40 comprises an electrically insulating housing 43 adapted to enclose the PCB (not shown for the sake of clarity). Ribs 41 extend on the inside of the housing 43 along the longitudinal direction of the essentially tube-shaped housing 43. In the ribs 41, slots 42 are arranged to receive the PCB. The slots 42 are arranged opposite each other in the housing 43, such that two opposing edges of the PCB can be slid into the slots 42. As shown in FIGS. 4A and 4B, the ribs 41 may be integral with the housing 43. Alternatively, the slots 42 may be arranged as recesses 42 provided directly in the housing 43, which may lack any ribs. The housing 43 reduces the risk of sparks being produced between the PCB and the heat sink and may for instance be made of plastics, such as thermal plastics or any other electrically insulating material. The housing 43 also enlarges the heat dissipating area of the PCB frame 40 as heat may be conducted from the slots 42 to the housing 43 and subsequently to a heat sink if such is provided around the housing 43.

Figure 5:
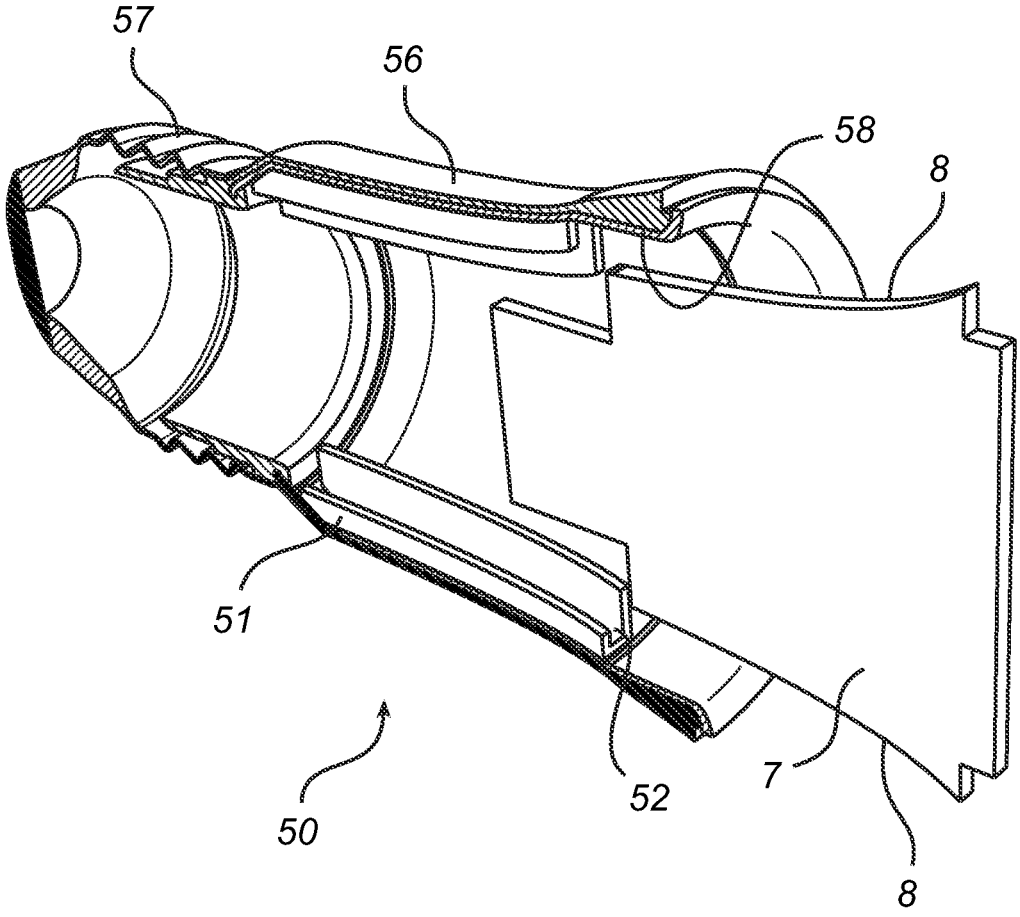
FIG. 5 is a cross-sectional view of a base of a lighting device according to an embodiment of the invention.

With reference to FIG. 5, another embodiment of the invention will be described. FIG. 5 is a cross-sectional view of a base 50 of a lighting device. In the present embodiment, the PCB frame comprises ribs 51, in which slots 52 extends, being attached, and preferably moulded (or glued), onto the inside of a heat sink 58 of the lighting device. Further, an overmould 56 is attached, and preferably moulded, onto the outside of the heat sink 58. The overmould 56 may for instance be about 1 mm thick. A portion of the over mould 56 may extend (or protrude) into a screw base 57 (or lower portion) of the base 50. A PCB 7 may be inserted in the base 50, e.g. by sliding the edges 8 of the PCB into the slots 52. When the lighting device is operated, heat may be conducted from the PCB to the ribs 51 and then further to the heat sink 58. The tight fitting of the ribs 51 to the inside of the heat sink 58 achieved by the moulding or gluing improves the heat conduction therebetween.

While specific embodiments have been described, the skilled person will understand that various modifications and alterations are conceivable within the scope as defined in the appended claims. For example, the materials, slot dimensions and PCB frame location and orientation described with reference to FIGS. 2A and 2B are applicable also to the embodiments described with reference to FIGS. 3A, 3B, 4A, 4B and 5. Further, it will be appreciated that the invention is applicable not only to LED-based lighting devices, but any lighting device comprising a PCB or circuit board with components requiring cooling for driving/controlling the lighting device.

The invention claimed is:

1. A lighting device comprising:

a light source;

a circuit board configured to control the light source; and a circuit board frame comprising a rib, a slot extending in the rib along a length of the rib, and an electrically insulating foil, wherein an edge of the circuit board is mounted in the slot along a longitudinal direction of the circuit board, such that the circuit board is in thermal contact with the circuit board frame, and wherein the foil and the rib together enclose the circuit board.

2. A lighting device as defined in claim 1, wherein the circuit board frame comprises an electrically insulating material for electrically insulating the circuit board.

3. A lighting device as defined in claim 1, wherein the circuit board frame is at least partly made of thermal plastic.

4. A lighting device as defined in claim 1, wherein the slot is substantially straight and the circuit board is curved.

5. A lighting device as defined in claim 1, further comprising a base having an external portion, wherein the circuit board frame is integral with the external portion of the base.

6. A lighting device comprising:

a light source;

a circuit board configured to control the light source;

a circuit board frame comprising a rib, a slot extending in the rib, and an electrically insulating foil, wherein an edge of the circuit board is mounted in the slot such that the circuit board is in thermal contact with the circuit board frame, and wherein the foil and the rib together enclose the circuit board; and a heat sink arranged in thermal contact with the circuit board frame.

7. A lighting device as defined in claim 1, wherein the slot is at least 1 mm deep.

8. A lighting device as defined in claim 1, wherein self heating components of the circuit board are arranged in proximity of said edge of the circuit board.

9. A lighting device as defined in claim 1, wherein the circuit board frame comprises an additional slot in which another edge of the circuit board is mounted such that the circuit board also is in thermal contact with the circuit board frame in said additional slot.

10. A lighting device as defined in claim 6, wherein the ribs are attached, onto the inside of the heat sink.

11. A lighting device as defined in claim 1, wherein the circuit board frame comprises a first rib and a second rib, a first slot extending in the first rib and a second slot extending in the second rib, wherein the first and second slots are disposed facing and opposing to each other, wherein a first an edge of the circuit board is mounted in the first slot and the second edge is mounted in the second slot.

12. A lighting device as defined in claim 1, wherein the ribs extend in a longitudinal direction and the edge of the circuit board is along the length of the circuit board.

13. A lighting device as defined in claim 1, wherein the foil is tube-shaped and the rib extends along a longitudinal direction of the tube-shaped foil.

14. A lighting device comprising:

a light source;

a circuit board configured to control the light source;

a tubular base;

a circuit board frame attached to the tubular base, the circuit board frame comprising a first rib and a second rib, a first slot extending in the first rib and a second slot extending in the second rib, wherein the first and second ribs are disposed facing and opposing to each other, and wherein a first edge of the circuit board is mounted in the first slot and a second edge of the circuit board is mounted in the second slot such that the circuit board is in thermal contact with the circuit board frame.

* * * * *